US007473192B2

(12) United States Patent
Makino et al.

(10) Patent No.: US 7,473,192 B2
(45) **Date of Patent: *Jan. 6, 2009**

(54) MULTI-PIECE SOLID GOLF BALL

(75) Inventors: Shinya Makino, Chichibu (JP); Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/953,395

(22) Filed: Dec. 10, 2007

(65) Prior Publication Data

US 2008/0125248 A1 May 29, 2008

Related U.S. Application Data

(63) Continuation-in-part of application No. 11/443,075, filed on May 31, 2006, now Pat. No. 7,377,864.

(51) Int. Cl.
*A63B 37/06* (2006.01)

(52) U.S. Cl. ..... 473/373

(58) Field of Classification Search ..... 473/373, 473/374, 368, 376

See application file for complete search history.

(56) References Cited

U.S. PATENT DOCUMENTS

| | | | |
|---|---|---|---|
| 6,520,872 | B2 | 2/2003 | Endo et al. |
| 7,066,836 | B2 | 6/2006 | Hayashi |
| 7,086,967 | B2 | 8/2006 | Watanabe et al. |
| 2003/0190976 | A1 | 10/2003 | Binette et al. |

FOREIGN PATENT DOCUMENTS

| | | | |
|---|---|---|---|
| JP | 2004-16583 | A | 1/2004 |

*Primary Examiner*—Raeann Trimiew
(74) *Attorney, Agent, or Firm*—Sughrue Mion, PLLC

(57) ABSTRACT

This invention provides a multi-piece golf ball composed of a core, an intermediate layer enclosing the core, and a cover layer which encloses the intermediate layer and has on an outside surface thereof a plurality of dimples. The cover layer is harder than the intermediate layer. Letting A be the thickness of the intermediate layer, B be the thickness of the cover layer and C be the diameter of the core, $65 \geqq C/A \geqq 30$ and $65 \geqq C/B \geqq 30$. In addition, a specific gravity of the core ranges from 1.0 to 1.2, a specific gravity of the intermediate layer ranges from 0.88 to 1.00, and the ball has an initial velocity, as measured by a method set forth in the Rules of Golf using an initial velocity measuring apparatus of the same type as the USGA drum rotation-type initial velocity instrument, of at least 77.0 m/s.

14 Claims, 1 Drawing Sheet

MULTI-PIECE SOLID GOLF BALL

CROSS-REFERENCE TO RELATED APPLICATION

This application is a continuation-in-part of copending application Ser. No. 11/443,075 filed on May 31, 2006, the entire contents of which are hereby incorporated by reference.

BACKGROUND OF THE INVENTION

The present invention relates to a multi-piece golf ball having at least a three-layer construction composed of a core, an intermediate layer and a cover layer. More specifically, the invention relates to a multi-piece golf ball having a high rebound resilience and durability, and having an excellent feel on impact. The invention also relates to a multi-piece golf ball which has a low spin rate and can travel a good distance even when hit at a low head speed.

The golfing population has grown in recent years, and the desires of players with regard to golf balls have become increasingly diverse and personalized. To address such desires, various investigations are being conducted on ball construction. Most players are amateur golfers with head speeds (HS) in a range of generally 30 to 45 m/s. Amateur golfers derive greater enjoyment from playing the game when the ball travels farther on shots with a driver and has a good, soft feel at the moment of impact. In addition, because amateur golfers have a head speed that is somewhat lower than that of professionals, it tends to be harder for them to get enough lift on the ball. Amateurs thus use clubs having a relatively high loft angle, as a result of which balls hit with a number one wood (W#1) tend to take on too much spin and acquire an excessive spin rate.

JP-A 2005-218858 teaches a golf ball having a core, an intermediate layer that encloses the core, and a cover that encloses the intermediate layer. By having the intermediate layer and the cover each formed of an ionomer resin-containing thermoplastic resin, and by concurrently optimizing the respective values for the core diameter, deflection of the core under 100 kg of loading, intermediate layer thickness, Shore D hardness of intermediate layer, cover thickness, Shore D hardness of cover, deflection of the golf ball under 100 kg of loading, and the difference obtained by subtracting the deflection of the golf ball under 100 kg of loading from the deflection of the core under 100 kg of loading, such a golf ball achieves a combination of a good, high rebound, low spin and good feel when used by the ordinary amateur golfer who values distance and feel more than spin performance.

JP-A 2004-16583 discloses a golf ball having, in order from the inside: a solid core of at least one layer, an intermediate layer, and a cover. In this ball, a good rebound and a soft feel on impact are achieved by optimizing the respective hardnesses and thicknesses of the core, intermediate layer and cover.

However, these golf balls leave room for further improvement in their distance of travel and feel on impact. In particular, the challenge has been how to lower the spin rate on the ball when hit with a driver in the low head speed range typical of the amateur golfer, and thereby improve the distance traveled by the ball.

SUMMARY OF THE INVENTION

It is therefore an object of the present invention to provide a multi-piece solid golf ball which achieves a combination of high rebound, low spin and good feel on impact, and which is particularly advantageous to the ordinary amateur golfer who values distance and feel more than the spin performance on approach shots.

As a result of extensive investigations, we have discovered that, on measuring the ball characteristics of a multi-piece golf ball which is composed of a core, an intermediate layer that encloses the core, and a cover layer that encloses the intermediate layer and has on an outside surface thereof a plurality of dimples, and in which the diameter or layer thickness of the respective components have been optimized within specific ranges, the instrumental initial velocity of the ball has been set to at least a given range, and the cover layer has been formed so as to be harder than the intermediate layer, the ball has a high rebound resilience and durability, an excellent feel on impact and, in particular, a low spin rate following ball impact, enabling a sufficient distance to be achieved even when hit within a low head speed range, and is thus beneficial for competitive use by the ordinary amateur golfer.

That is, we have found that, when the ordinary amateur golfer uses a relatively high-loft driver, to keep the golf ball from taking on excessive spin and greatly improve the straightness of the ball's trajectory so that a good distance can be achieved, it is important, as noted above, to optimize the hardness and thickness ratios of the respective ball components within specific ranges.

Accordingly, the invention provides the following golf ball [I] and [II].

[I] A multi-piece golf ball comprising a core, an intermediate layer enclosing the core, and a cover layer which encloses the intermediate layer and has on an outside surface thereof a plurality of dimples, wherein the cover layer is harder than the intermediate layer; letting A be the thickness of the intermediate layer, B be the thickness of the cover layer and C be the diameter of the core, $65 \geqq C/A \geqq 31$ and $65 \geqq C/B \geqq 30$; a specific gravity of the core ranges from 1.0 to 1.2, a specific gravity of the intermediate layer ranges from 0.88 to 1.00, and the ball has an initial velocity, as measured by a method set forth in the Rules of Golf using an initial velocity measuring apparatus of the same type as the USGA drum rotation-type initial velocity instrument, of at least 77.0 m/s.

[II] A multi-piece golf ball comprising a core, an intermediate layer enclosing the core, and a cover layer which encloses the intermediate layer and has on an outside surface thereof a plurality of dimples, wherein the cover layer is harder than the intermediate layer; letting A be the thickness of the intermediate layer, B be the thickness of the cover layer and C be the diameter of the core, $65 \geqq C/A \geqq 30$ and $65 \geqq C/B \geqq 31$; a specific gravity of the core ranges from 1.0 to 1.2, a specific gravity of the intermediate layer ranges from 0.88 to 1.00, and the ball has an initial velocity, as measured by a method set forth in the Rules of Golf using an initial velocity measuring apparatus of the same type as the USGA drum rotation-type initial velocity instrument, of at least 77.0 m/s.

BRIEF DESCRIPTION OF THE DIAGRAMS

DETAILED DESCRIPTION OF THE INVENTION

Figure 1:
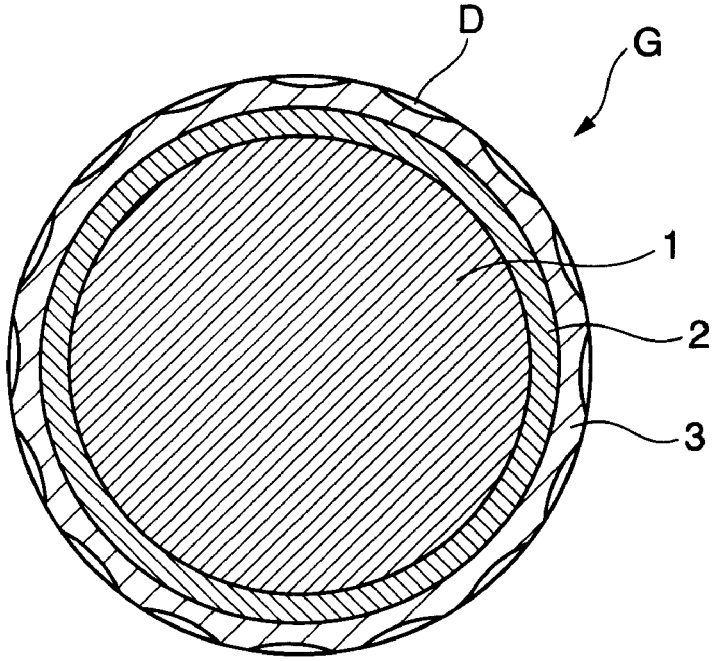
FIG. 1 is a schematic sectional view showing a multi-piece solid golf ball with a three-layer construction according to the invention.

The multi-piece solid golf ball of the invention has a construction which includes a core, an intermediate layer enclosing the core, and a cover layer which encloses the intermediate layer and has on an outside surface thereof a plurality of dimples. Specifically, the inventive ball is exemplified by the multi-piece solid golf ball G shown in FIG. 1, which has a multi-layer construction composed of a core 1 at the innermost center, a cover layer 3 as the outermost layer, and an intermediate layer 2 therebetween. A plurality of dimples D are formed on the outside surface of the cover layer 3. The intermediate layer 2 and the cover layer 3 may each be composed of one or more layer. The construction of the invention ball is not limited to the construction shown in FIG. 1.

Specific details on the core, intermediate layer, cover layer and dimples that may be used in the inventive ball are described separately below for each ball component.

The core has a diameter of typically at least 35.3 mm but not more than 40.7 mm, preferably at least 36.3 mm but not more than 39.7 mm, and more preferably at least 37.3 mm but not more than 38.7 mm. If the core diameter is too small, a low spin effect may not be obtained, which may not keep the ball from achieving the desired distance. Conversely, if the core diameter is too large, a low spin effect may likewise not be obtained or the durability of the ball to repeated impact may worsen.

The core has a deflection, measured as the deformation when the core is subjected to loading from an initial load state of 98 N (10 kgf) to a final load of 1,275 N (130 kgf), of preferably at least 2.5 mm, more preferably at least 3.0 mm, and even more preferably at least 3.3 mm. The upper limit is preferably not more than 5.5 mm, more preferably not more than 5.0 mm, and even more preferably not more than 4.3 mm. When this deflection is smaller than the above range, the ball tends to take on too much spin, reducing the distance of travel, and the feel of the ball on impact tends to be too hard. Conversely, when the deflection is too large, there is a tendency for the rebound to become too small, reducing the distance of travel, for the feel on impact to be too soft, and for the durability of the ball to repeated impact to worsen.

Optimizing the specific gravity of the core is desirable for improving such ball properties as the initial velocity and durability. The specific gravity of the core is at least 1.0, preferably at least 1.05, and more preferably at least 1.1, but not more than 1.2. At a core specific gravity higher than the above range, the weight of the cover layer must be reduced, which decreases the moment of inertia and thus tends to result in a loss in the straightness of the ball's path. On the other hand, at a core specific gravity lower than the above range, the ball tends to have a lower durability and initial velocity.

If the surface of the core is harder than the subsequently described intermediate layer, the ball may take on greater spin and thus travel less far. Hence, it is desirable for the core to have a surface hardness which is lower than the hardness of the intermediate layer. However, if the surface hardness of the core is too much softer than the hardness of the intermediate layer, the ball may have a poor durability to repeated impact and may have a decreased rebound, shortening the distance of travel. The difference between the subsequently described Shore D hardness of the intermediate layer and the Shore D hardness at the surface of the core is generally at least 0 but less than 10, and preferably at least 1 but less than 5.

The core has a surface hardness (Shore D hardness) of generally at least 45 but not more than 55, preferably at least 46 but not more than 54, and more preferably at least 47 but not more than 52. If the surface hardness of the core is too high, the ball may take on too much spin, shortening the distance of travel, and the ball may have too hard a feel on impact. Conversely, if the surface hardness of the core is too low, the rebound may decrease, shortening the distance of travel, the ball may have too soft a feel, and the durability of the ball to repeated impact may worsen.

Core materials capable of satisfying the above-indicated numerical ranges are not subject to any particular limitation, although use may be suitably made of any of various synthetic rubbers, such as polybutadiene rubber, polyisoprene rubber or styrene-butadiene rubber, as the base rubber. Using a polybutadiene rubber is preferred. The use of a polybutadiene rubber synthesized with a rare-earth catalyst greatly improves the rebound, and is thus especially preferred.

Examples of various ingredients that may compounded with the base rubber so as to crosslink and otherwise modify the base rubber include known ingredients such as unsaturated carboxylic acids or metal salts thereof (e.g., zinc acrylate), organic peroxides, inorganic fillers (e.g., zinc oxide, barium sulfate) and antioxidants. The ingredients used for this purpose may be commercial products. By suitably selecting the amounts in which the various ingredients are compounded with the base rubber, particularly the amounts in which the unsaturated carboxylic acids or metal salts thereof and the various inorganic fillers are used, it is possible to obtain a core which satisfies the above-indicated numerical ranges. The desired core may be obtained by a method such as molding and vulcanizing, under specific time and temperature conditions, a rubber composition of the foregoing base rubber and compounding ingredients. Given that the deflection and internal hardness of the rubber vary also with these vulcanization conditions, a resilient core which satisfies the above numerical ranges may be fabricated by suitably adjusting the vulcanization conditions.

The intermediate layer enclosing the core has a thickness of preferably at least 0.5 mm, with an upper limit of generally at most 1.7 mm, preferably at most 1.4 mm, and more preferably at most 1.25 mm. If the intermediate layer is too thin, the durability of the ball to cracking with repeated impact may worsen and the ball rebound may decrease, shortening the distance traveled by the ball. On the other hand, too thick an intermediate layer may increase the spin rate, also shortening the distance traveled by the ball.

The intermediate layer has a Shore D hardness of preferably at least 40, more preferably at least 45, and even more preferably at least 48, but preferably not more than 60, more preferably not more than 55, and even more preferably not more than 52. As used herein, "Shore D hardness" refers to a measured value obtained for a sheet-like shaped specimen using a type D durometer in accordance with ASTM D2240. If the intermediate layer is too soft, the spin rate of the ball may rise excessively or the ball rebound may decrease, resulting in a shorter distance of travel. Conversely, if the intermediate layer is too hard, the ball may have a poor durability to cracking on repeated impact and a poor feel when played.

For the ball to conform with United States Golf Association (USGA) rules and to enable the ball to follow a straight trajectory, it is desirable for the specific gravity of the intermediate layer to be optimized as follows. That is, the specific gravity of the intermediate layer is set to at least 0.88, preferably at least 0.90, and more preferably at least 0.92. The upper limit is not more than 1.00, preferably not more than 0.98, and more preferably not more than 0.96. If the specific gravity of the intermediate layer is higher than the above range, the ball may become too heavy and fail to conform with USGA rules. On the other hand, if the specific gravity is smaller than the above range, the ball may lose its ability to maintain a straight trajectory.

Intermediate layer materials which satisfy the above numerical ranges are not subject to any particular limitation, and include thermoplastic resins and thermoplastic elastomers. Specific examples include any of various known thermoplastic resins or elastomers, such as ionomer resins, urethane resins, polyolefin elastomers, polyester elastomer and polyamide elastomers. Of these, the use of an ionomer resin or a thermoplastic resin containing an ionomer resin is especially preferred for improving the rebound and durability of the ball.

Various additives may optionally be included in the above intermediate layer material. For example, inorganic fillers and pigments (e.g., zinc oxide, barium sulfate, titanium dioxide), dispersants, antioxidants, ultraviolet absorbers, and light stabilizers may be added.

Any of various known methods, such as injection molding or compression molding, may be used to form the intermediate layer. With regard to such conditions as the injection temperature and time, the intermediate layer can be easily formed by suitably selecting from the range of such conditions ordinarily employed for this purpose.

Next, the cover layer which serves as the outermost layer of the inventive golf ball is described. The cover layer has a thickness of preferably at least 0.5 mm, more preferably at least 0.9 mm, and even more preferably at least 1.0 mm, but not more than 2.0 mm, preferably not more than 1.6 mm, and even more preferably not more than 1.25 mm. If the cover layer is thinner than the above range, the ball may have a poor durability to cracking on repeated impact and may have a decreased rebound, resulting in shorter distance of travel. On the other hand, if the cover layer is thicker than the above range, the spin rate on the ball may increase, shortening the distance traveled by the ball.

The cover has a Shore D hardness of preferably at least 55, more preferably at least 57, and even more preferably at least 60, but preferably not more than 70, more preferably not more than 66, and even more preferably not more than 63. If the cover layer is softer than the above range, the ball may take on too much spin or the rebound may decrease, shortening the distance traveled by the ball. Also, the scuff resistance of the ball may worsen. Conversely, if the cover layer is harder than the above range, the ball may have a poor durability to cracking on repeated impact, and may have a poor feel in the short game or on shots taken with a putter.

In the invention, it is critical for the cover layer to be harder than the intermediate layer. If the cover layer is softer than the intermediate layer, a lower spin rate will not be achieved, preventing the objects of the invention from being attained.

For the golf ball to conform with USGA rules and maintain a straight trajectory when played, it is desirable to optimize the specific gravity of the cover layer as follows. That is, the cover layer is set to a specific gravity of preferably at least 0.91, more preferably at least 0.93, and even more preferably at least 0.95, but preferably not more than 1.30, more preferably not more than 1.10, and even more preferably not more than 0.99. If the specific gravity of the cover layer is higher than the above range, the ball may be too heavy and fail to conform with USGA rules. Conversely, if the cover layer has a specific gravity which is lower than the above range, the ball may lose its ability to maintain a straight trajectory.

A known material may be suitably selected for use in the cover layer so as to satisfy the respective above ranges in numerical values. The range of selection for this material is similar to that for the above-described intermediate layer material. However, as explained above with reference to the intermediate layer material, to improve the rebound and durability of the ball, it is preferable to use an ionomer resin or a thermoplastic resin containing an ionomer resin. The material used in the cover layer may be of the same type or a different type as the material used in the intermediate layer. Moreover, use can be made of a single type of material or a mixture of two or more different materials. As with the above-described method of forming the intermediate layer, a known method such as injection molding or compression molding may be used to form the cover layer.

The intermediate layer and the cover layer have a combined thickness of generally at least 1.0 mm but not more than 3.0 mm, and preferably at least 2.7 mm but not more than 2.5 mm. If the combined thickness is too small, the durability to cracking under repeated impact may worsen. On the other hand, if the combined thickness is too large, the ball may take on too much spin at the moment of impact with a driver, which may shorten the distance traveled by the ball.

The objects of the invention can be achieved by optimizing in the following manner the relationship between the above-described intermediate layer thickness, cover layer thickness and cover diameter.

In the invention, letting A be the thickness of the intermediate layer, B be the thickness of the cover layer and C be the diameter of the core, it is critical that C/A and C/B are optimized in a specific range respectively.

The above value C/A (core diameter/intermediate layer thickness) is 65 or less, preferably 60 or less, more preferably 50 or less, and even more preferably 40 or less, but is 30 or more, preferably 31 or more, and more preferably 32 or more. If this value is too small, the intermediate layer thickness relative to the core diameter will be too large, compromising the feel of the ball at the moment of impact and also increasing the spin rate, thereby shortening the distance traveled by the ball. Conversely, if this value is too large, the intermediate layer thickness relative to the core diameter will be too small, making formation of the layer more difficult.

The above value C/B (core diameter/cover layer thickness) is 65 or less, preferably 60 or less, more preferably 50 or less, and even more preferably 40 or less, but is 30 or more, preferably 31 or more. If this value is too small, the cover layer thickness relative to the core diameter will be too large, compromising the feel of the ball at the moment of impact and also increasing the spin rate, thereby shortening the distance traveled by the ball. Conversely, if this value is too large, the cover layer thickness relative to the core diameter will be too small, making formation of the layer more difficult.

In the present invention, it is essential for the initial velocity (m/s) of the ball to be at least 77.0 m/s. The initial velocity here is a value measured using an initial velocity measuring apparatus of the same type as the USGA drum rotation-type initial velocity instrument approved by the Royal and Ancient Golf Club of St. Andrews (R&A). The ball is temperature conditioned in a 23±1° C. environment for at least 3 hours, then tested in a chamber at a room temperature of 23±2° C. The ball is hit using a 250-pound (113.4 kg) head (striking mass) at an impact velocity of 143.8 ft/s (43.83 m/s). One dozen balls are each hit four times. The length of time taken by the ball to traverse a distance of 6.28 ft (1.91 m) was measured and used to compute the initial velocity (m/s) of the ball. This cycle is carried out over a period of about 15 minutes.

The initial velocity must be at least 77.0 m/s, and is preferably at least 77.1 m/s, and more preferably at least 77.2 m/s, but is preferably not more than 77.7 m/s. If the initial velocity is too high, the golf ball may fail to conform with R&A rules. On the other hand, if the initial velocity is too low, the ball will travel a shorter distance when played.

A plurality of dimples are formed on the surface of the cover. The number of dimples arranged on the cover surface, while not subject to any particular limitation, is preferably at least 300 but not more than 500, and more preferably at least 320 but not more than 450. If the number of dimples exceeds the above range, the trajectory of the ball may become lower, resulting in a shorter distance of travel than desired. Conversely, if the number of dimples is less than the above range, the ball may follow a higher trajectory, which may excessively shorten the distance traveled by the ball, particularly on shots taken with an iron.

Any one or combination of two or more dimple shapes, including circular and non-circular shapes (e.g., various polygonal shapes, dewdrop shapes, and oval shapes) may be suitably used. If circular dimples are used, the diameter of the dimples may be set to at least 2 mm but not more than 6 mm, and preferably at least 3 mm but not more than 5 mm.

The total volume of the dimples on a ball, while not subject to any particular limitation, is preferably at least 200 $mm^3$ but not more than 450 $mm^3$, and more preferably at least 250 $mm^3$ but not more than 400 $mm^3$. At a total dimple volume larger than the above range, the trajectory of the ball may be lower, shortening the distance traveled by the ball. Conversely, at a total dimple volume smaller than the above range, the ball trajectory may become too high, resulting in a shorter distance of travel.

The dimple spatial volume below a flat plane circumscribed by the edge of each dimple, summed for all the dimples and expressed as a ratio with respect to the total volume of an imaginary sphere represented by the surface of the golf ball were it to be free of dimples (dimple total volume ratio $V_r$), is preferably at least 0.6% but not more than 1.0%, more preferably at least 0.65% but not more than 0.9%, and even more preferably at least 0.7% but not more than 0.8%. Moreover, the value $V_0$ obtained by dividing the dimple spatial volume of a dimple below a flat plane circumscribed by the edge of each dimple by the volume of a cylinder whose base is the flat plane and whose height is the maximum depth from the base is preferably at least 0.40 but not more than 0.65, and more preferably at least 0.43 but not more than 0.60. By carrying out dimple design so as to satisfy both of these values $V_r$ and $V_0$, it is possible to reduce the ball's coefficient of drag and increase the coefficient of lift, thereby lengthening the distance traveled by the ball. In this case, if $V_0$ is greater than 0.65, the ball may assume too high a trajectory and lose speed, preventing it from traveling a sufficient distance. On the other hand, if $V_0$ is less than 0.40, the ball may assume a trajectory which drops somewhat low. Also, if the $V_r$ value is less than 0.6%, the ball may arc too high, whereas if the $V_r$ value is more than 1.0%, a sufficient decrease in the coefficient of drag may not be achieved. Either extreme may shorten the distance traveled by the ball.

It is advantageous for the dimples to have a volume ratio CR with respect to the volume of the cover which is at least 4% but not more than 10%, preferably at least 4% but not more than 9%, and more preferably at least 4% but not more than 8%. If this volume ratio CR is too large, the durability of the ball to repeated impact may worsen, the trajectory of the ball may be lower, and the ball may travel a shorter distance. On the other hand, if the volume ratio CR is too small, the spin-lowering effect may be inadequate, shortening the distance traveled by the ball, or the ball may assume an excessively high trajectory, likewise shortening the distance of travel.

The multi-layer solid golf ball of the invention can be made to conform with the Rules of Golf for competitive play, and can be formed to a diameter of not less than 42.67 mm and a weight of not more than 45.93 g. The upper limit in the diameter is preferably 44.0 mm or less, more preferably 43.5 mm or less, and even more preferably 43.0 mm or less. The lower limit in the weight is preferably at least 44.5 g, more preferably at least 44.8 g, even more preferably at least 45.0 g, and most preferably at least 45.1 g.

As explained above, the multi-piece golf ball of the invention has a high rebound resilience and durability, and an excellent feel at the moment of impact. Moreover, the multi-piece golf ball of the invention, owing to its low spin effect, can travel a longer distance even when hit at a low head speed.

EXAMPLES

Examples of the invention and Comparative Examples are given below by way of illustration, and not by way of limitation.

Examples 1 and 2, Comparative Examples 1 to 9

Polybutadiene, zinc oxide, antioxidant, zinc acrylate and organic peroxide were mixed in the proportions shown in Table 1 (the numbers indicate weight ratios, the same applies below), masticated in a kneader, then extruded and subsequently molded under pressure at 155° C. for 15 minutes to form solid cores made of rubber compositions of the indicated formulations for the respective examples of the invention and comparative examples.

TABLE 1

| | a | b | c | d | e | f | g |
|---|---|---|---|---|---|---|---|
| Polybutadiene (1)[1)] | 0 | 0 | 0 | 0 | 0 | 0 | 100 |
| Polybutadiene (2)[2)] | 100.0 | 100.0 | 100.0 | 100.0 | 100.0 | 100.0 | 0.0 |
| Organic peroxide (1)[3)] | 0.6 | 0.6 | 0.6 | 0.6 | 0.6 | 0.6 | 0.6 |
| Organic peroxide (2)[4)] | 0.6 | 0.6 | 0.6 | 0.6 | 0.6 | 0.6 | 0.6 |
| Zinc oxide | 26.7 | 27.3 | 27.6 | 25.5 | 28.2 | 26.1 | 27.3 |
| Antioxidant[5)] | 0.1 | 0.1 | 0.1 | 0.1 | 0.1 | 0.1 | 0.1 |
| Zinc acrylate | 24.2 | 22.7 | 25.7 | 25.7 | 24.2 | 24.2 | 22.7 |

Note:
Numbers in the table represent parts by weight.
The above materials are described below.
[1)]A polybutadiene rubber produced by JSR Corporation under the product name BR01.
[2)]A polybutadiene rubber produced by JSR Corporation under the product name BR730.
[3)]Organic peroxide (1): Dicumyl peroxide, produced by NOF Corporation under the product name Percumyl D.
[4)]Organic peroxide (2): A mixture of 1,1-di(t-butylperoxy)-cyclohexane and silica, produced by NOF Corporation under the product name Perhexa C40.
[5)]An antioxidant produced by Ouchi Shinko Chemical Industry Co., Ltd. under the product name Nocrac NS-6.

Next, cover material A shown in Table 2 was injection molded over the solid core to form an intermediate layer, then cover layer B was injection molded over the intermediate layer, thereby giving a golf ball. At the same time that the cover material used in the respective examples was molded, numerous dimples were formed on the outside surface of the cover layer. Details on the dimples in each example are shown collectively in Table 4 for each type of dimple.

TABLE 2

| | A | B |
|---|---|---|
| AM7331 (product name)[6)] | 85 | |
| Himilan 1706 (product name)[6)] | | 25 |
| Himilan 1605 (product name)[6)] | | 50 |
| Surlyn 9945 (product name)[7)] | | 25 |
| Dynaron E6100P (product name)[8)] | 15 | |
| Behenic acid[9)] | 20 | |
| Calcium hydroxide[10)] | 2.9 | |
| Titanium oxide | | 3 |
| MFR[11)] | 2.2 | 2.9 |

Note:
Numbers in the table represent parts by weight.
[6)]An ionomer produced by DuPont-Mitsui Polychemicals Co., Ltd.
[7)]An ionomer produced by E. I. DuPont de Nemours & Co.
[8)]A hydrogenated polymer produced by JSR Corporation.
[9)]Produced by NOF corporation under the product name NAA222-S.
[10)]Produced by Shiraishi Kogyo under the product name CLS-B.
[11)]The melt flow rate of the material measured in accordance with JIS-K6760 (test temperature, 190° C.; test load, 21 N (2.16 kgf).

Table 3 below shows the properties of the golf balls obtained in each example of the invention and each comparative example, and shows also the thickness, hardness and other properties of the core, intermediate layer and cover making up the respective balls. Table 5 below shows the flight performance, durability and feel on impact of each ball.

TABLE 3

| | | Example | | Comparative Example | | | | | | | | |
|---|---|---|---|---|---|---|---|---|---|---|---|---|
| | | 1 | 2 | 1 | 2 | 3 | 4 | 5 | 6 | 7 | 8 | 9 |
| Core | Material | a | b | c | c | d | d | e | e | f | f | g |
| | Diameter (mm) | 38.10 | 38.11 | 37.30 | 37.30 | 39.30 | 39.30 | 37.28 | 37.28 | 39.31 | 39.31 | 38.12 |
| | Weight (g) | 34.5 | 34.7 | 32.6 | 32.6 | 37.3 | 37.3 | 32.6 | 32.6 | 37.2 | 37.2 | 34.2 |
| | Specific gravity | 1.17 | 1.17 | 1.18 | 1.18 | 1.16 | 1.16 | 1.18 | 1.18 | 1.16 | 1.16 | 1.17 |
| | 10-130 kg deflection (mm) | 3.6 | 3.9 | 3.7 | 3.7 | 3.6 | 3.6 | 3.9 | 3.9 | 3.9 | 3.9 | 3.9 |
| | Surface hardness (Shore D) | 50 | 47 | 49 | 49 | 50 | 50 | 47 | 47 | 47 | 47 | 47 |
| | Core volume ($mm^3$) | 29.0 | 29.0 | 27.2 | 27.2 | 31.8 | 31.8 | 27.1 | 27.1 | 31.8 | 31.8 | 29.0 |
| Intermediate layer | Material | A | A | A | A | A | A | A | A | A | A | A |
| | Specific gravity | 0.94 | 0.94 | 0.94 | 0.94 | 0.94 | 0.94 | 0.94 | 0.94 | 0.94 | 0.94 | 0.94 |
| | Shore D hardness | 51 | 51 | 51 | 51 | 51 | 51 | 51 | 51 | 51 | 51 | 51 |
| | Thickness (mm) | 1.11 | 1.09 | 1.20 | 1.49 | 0.50 | 1.19 | 1.20 | 1.50 | 0.50 | 1.17 | 1.11 |
| | Outside diameter (mm) | 40.3 | 40.3 | 39.7 | 40.3 | 40.3 | 41.7 | 39.7 | 40.3 | 40.3 | 41.7 | 40.3 |
| | Weight (g) | 39.8 | 39.8 | 37.9 | 39.3 | 39.6 | 42.9 | 37.9 | 39.3 | 39.5 | 43.0 | 39.4 |
| | 10-130 kg hardness (mm) | 3.37 | 3.67 | 3.38 | 3.35 | 3.43 | 3.31 | 3.61 | 3.65 | 3.67 | 3.58 | 3.63 |
| | (Core + intermediate layer) volume | 34.3 | 34.3 | 32.8 | 34.2 | 34.3 | 37.9 | 32.7 | 34.2 | 34.3 | 37.8 | 34.3 |
| | Intermediate layer volume | 5.3 | 5.3 | 5.6 | 7.1 | 2.5 | 6.1 | 5.6 | 7.1 | 2.5 | 6.0 | 5.3 |
| Product | Cover layer material | B | B | B | B | B | B | B | B | B | B | B |
| | Specific gravity | 0.98 | 0.98 | 0.98 | 0.98 | 0.98 | 0.98 | 0.98 | 0.98 | 0.98 | 0.98 | 0.98 |
| | Shore D hardness | 63 | 63 | 63 | 63 | 63 | 63 | 63 | 63 | 63 | 63 | 63 |
| | Thickness (mm) | 1.20 | 1.20 | 1.50 | 1.20 | 1.20 | 0.52 | 1.51 | 1.21 | 1.20 | 0.52 | 1.20 |
| | Outside diameter (mm) | 42.7 | 42.7 | 42.7 | 42.7 | 42.7 | 42.7 | 42.7 | 42.7 | 42.7 | 42.7 | 42.7 |
| | Weight (g) | 45.7 | 45.7 | 45.5 | 45.6 | 45.5 | 45.4 | 45.5 | 45.5 | 45.4 | 45.4 | 45.4 |
| | 10-130 kg deflection (mm) | 3.03 | 3.23 | 3.05 | 3.08 | 3.02 | 3.10 | 3.20 | 3.26 | 3.31 | 3.28 | 3.18 |
| | Initial velocity (m/s) | 77.1 | 77.1 | 77.0 | 77.1 | 77.1 | 77.1 | 77.1 | 77.1 | 77.1 | 77.2 | 76.8 |
| | Volume ($mm^3$) | 40.8 | 40.8 | 40.7 | 40.7 | 40.8 | 40.8 | 40.8 | 40.7 | 40.8 | 40.7 | 40.9 |
| | Cover volume ($mm^3$) | 6.5 | 6.5 | 8.0 | 6.5 | 6.5 | 2.9 | 8.1 | 6.5 | 6.5 | 2.9 | 6.5 |
| | Core diameter/ intermediate layer thickness | 34.4 | 34.8 | 31.1 | 25.0 | 78.6 | 33.0 | 31.1 | 24.9 | 78.6 | 33.6 | 34.5 |
| | Core diameter/ cover thickness | 31.9 | 31.8 | 24.9 | 31.1 | 32.7 | 76.3 | 24.7 | 30.9 | 32.9 | 76.3 | 31.8 |
| | Dimple volume ($mm^3$) | 308 | 308 | 308 | 308 | 308 | 308 | 308 | 308 | 308 | 308 | 308 |
| | CR | 4.8 | 4.8 | 3.9 | 4.8 | 4.7 | 10.7 | 3.8 | 4.7 | 4.8 | 10.7 | 4.7 |

The methods used to measure the above properties are described below.

Deflection (mm)

The deformation (mm) by a spherical body, whether a core or a ball, when subjected to loading from an initial load state of 98 N (10 kgf) to a final load of 1,275 N (130 kgf) was measured.

Core Surface Hardness (Shore D Hardness)

The durometer indenter was set perpendicular to the curved surface of the core, and the hardness was measured in accordance with ASTM D-2240, Type D.

Hardness of Intermediate Layer and Cover Layer (Shore D Hardness)

The cover composition was formed under applied heat and pressure to a thickness of about 2 mm, and the resulting sheet was held at 23° C. for 2 weeks, following which the hardness was measured in accordance with ASTM D2240, Type D.

Initial Velocity of Ball (m/s)

The initial velocity was measured using an initial velocity measuring apparatus of the same type as the USGA drum rotation-type initial velocity instrument approved by the R&A. The ball was temperature conditioned at a temperature of 23±1° C. for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity of the ball. This cycle was carried out over a period of about 15 minutes.

Volume of Cover Layer ($mm^3$)

The volume of the cover layer was the value obtained by subtracting the volume of the spherical body consisting of the core enclosed by the intermediate layer from the volume of the ball, as computed from the diameter of the ball when the ball is assumed to have no dimples thereon.

Ratio of Dimple Volume to Cover Volume (CR)

This ratio is the sum for all the dimples on the ball of the individual dimple volumes under a flat plane circumscribed by the dimple edge, divided by the volume of the cover layer as defined above, and expressed in percent (%).

Figure 2:
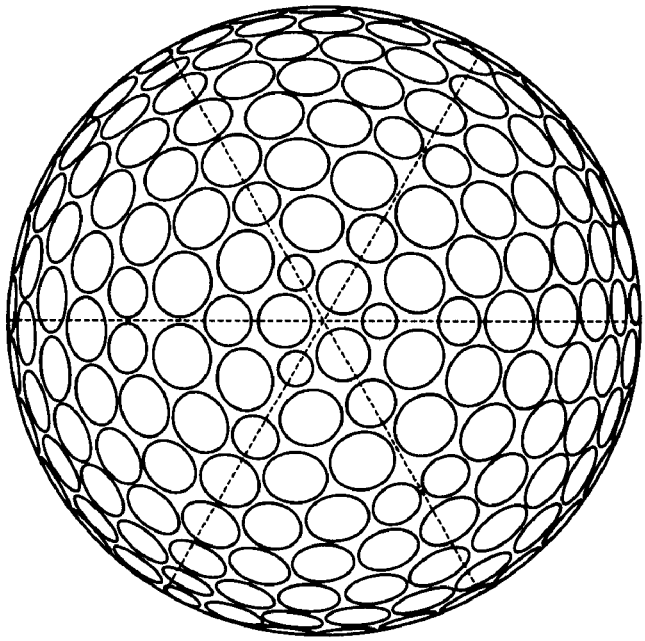
FIG. 2 is a top view showing an arrangement of dimples used in an embodiment of the invention.

The characteristics of the dimples in the respective examples of the invention and comparative examples are shown in Table 4 below. The dimple arrangement pattern is shown in FIG. 2.

TABLE 4

| | Number | Diameter (mm) | Depth (mm) | $V_0$ | Volume of one dimple ($mm^3$) | Total volume per type of dimple ($mm^3$) | Surface area of one dimple ($mm^2$) | Total surface area per type of dimple ($mm^2$) | $v_r$ (%) | Total dimple volume ($mm^3$) |
|---|---|---|---|---|---|---|---|---|---|---|
| 1 | 12 | 4.573 | 0.138 | 0.481 | 1.089 | 13.065 | 16.425 | 197.1 | 0.757 | 308 |
| 2 | 198 | 4.370 | 0.135 | 0.487 | 0.983 | 194.680 | 14.997 | 2969.3 | | |
| 3 | 36 | 3.799 | 0.127 | 0.480 | 0.692 | 24.929 | 11.336 | 408.1 | | |
| 4 | 6 | 3.450 | 0.135 | 0.472 | 0.596 | 3.578 | 9.349 | 56.1 | | |
| 5 | 12 | 2.687 | 0.110 | 0.453 | 0.283 | 3.400 | 5.669 | 68.0 | | |
| 6 | 36 | 4.406 | 0.171 | 0.479 | 1.249 | 44.957 | 15.250 | 549.0 | | |
| 7 | 24 | 3.822 | 0.161 | 0.468 | 0.864 | 20.725 | 11.472 | 275.3 | | |
| 8 | 6 | 3.278 | 0.132 | 0.460 | 0.512 | 3.070 | 8.440 | 50.6 | | |
| Total | 330 | | | | | 308 | | 4573.6 | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

$V_r$: Sum of volumes of individual dimples formed below flat plane circumscribed by dimple edge, as a percentage of volume of ball sphere were it to have no dimples thereon.

Spin Performance

The initial spin by the ball when hit at a head speed of 35 m/s with a W#1 mounted on a golf swing robot was measured. The club used was the BEAM CL, manufactured by Bridgestone Sports Co., Ltd.

Good: Back spin was less than 3,100 rpm

NG: Back spin was 3,100 rpm or more

Durability to Repeated Impact

The durability of the ball when repeatedly hit at a head speed of 50 m/s was rated as indicated below. Durability was expressed as an index based on a value of "100" for the durability of the ball in Example 2. Each value shown in the table is the average of measurements from five test iterations.

Rating

Good: Did not crack at a durability index of 100

NG: Cracked at a durability index below 100

TABLE 5

| | | Example | | Comparative Example | | | | | | | | |
|---|---|---|---|---|---|---|---|---|---|---|---|---|
| | | 1 | 2 | 1 | 2 | 3 | 4 | 5 | 6 | 7 | 8 | 9 |
| Flight tests | Back spin (rpm) | 3035 | 3000 | 3259 | 3307 | 3186 | 3171 | 3259 | 3102 | 3006 | 2981 | 3008 |
| | Carry (m) | 151.9 | 152.1 | 151.8 | 151.2 | 151.5 | 151.1 | 151.8 | 151.0 | 151.6 | 151.1 | 149.7 |
| | Total distance (m) | 175.3 | 176.2 | 173.5 | 173.9 | 174.8 | 174.2 | 175.5 | 174.8 | 174.1 | 175.0 | 173.8 |
| | Distance performance (rating) | good | good | NG | NG | NG | NG | good | NG | NG | good | NG |
| | Spin performance (rating) | good | good | NG | NG | NG | good | NG | NG | good | good | good |
| Durability to repeated impact | Number of shots until ball cracked | 114 | 100 | 133 | 117 | 81 | 72 | 121 | 117 | 68 | 61 | 104 |
| | Durability to cracking (rating) | good | good | good | good | NG | NG | good | good | NG | NG | good |
| Feel on impact | | good | good | good | good | good | good | good | good | good | good | good |

Distance Performance

The distance traveled by the ball when hit at a head speed of 35 m/s with a number one wood (W#1) mounted on a golf swing robot was measured. The club used was the BEAM CL, manufactured by Bridgestone Sports Co., Ltd.

Good: Total distance was 175 m or more

NG: Total distance was less than 175 m

Feel

The feel on impact of each ball when hit with a W#1 was sensory evaluated by 10 amateur golfers having head speeds of 35 to 40 m/s, and rated as follows.

Good: 7 or more of the golfers judged the ball to have a good, soft feel.

NG: All other balls

As is apparent from the results in Table 3, the golf balls obtained in Examples 1 and 2 of the invention had a substantially improved distance, an excellent feel and an excellent durability to impact.

By contrast, in Comparative Example 1, the ball had a thick cover layer and had a high spin rate at the moment of impact, resulting in a shortened distance.

In Comparative Example 2, the intermediate layer was thick and the spin rate at the moment of impact was high, resulting in a shortened distance.

In Comparative Example 3, the intermediate layer was thin, resulting in a poor durability to cracking.

In Comparative Example 4, the cover layer was thin, resulting in a shortened distance and a poor durability to cracking.

In Comparative Example 5, the cover layer was thick and the spin rate was high, resulting in a poor spin performance.

In Comparative Example 6, the intermediate layer was thick and the spin rate at the moment of impact was high, resulting in a shortened distance.

In Comparative Example 7, the intermediate layer was thin, the distance traveled was short, and the durability to cracking was poor.

In Comparative Example 8, the cover layer was thin, resulting in a poor durability to cracking.

In Comparative Example 9, the ball had a low initial velocity, resulting in a shortened distance.

The invention claimed is:

1. A multi-piece golf ball comprising a core, an intermediate layer enclosing the core, and a cover layer which encloses the intermediate layer and has on an outside surface thereof a plurality of dimples, wherein the cover layer is harder than the intermediate layer; letting A be the thickness of the intermediate layer, B be the thickness of the cover layer and C be the diameter of the core, $65 \geqq C/A \geqq 31$ and $65 \geqq C/B \geqq 30$; a specific gravity of the core ranges from 1.0 to 1.2, a specific gravity of the intermediate layer ranges from 0.88 to 1.00, and the ball has an initial velocity, as measured by a method set forth in the Rules of Golf using an initial velocity measuring apparatus of the same type as the USGA drum rotation-type initial velocity instrument, of at least 77.0 m/s.

2. The golf ball of claim 1, wherein the dimples have a volume ratio CR with respect to the volume of the cover of at least 4% but not more than 10%.

3. The golf ball of claim 1, wherein the core has a diameter of at least 35.3 mm but not more than 38.7 mm.

4. The golf ball of claim 1, wherein a difference between a Shore D hardness of the intermediate layer and a Shore D hardness at the surface of the core ranges from 1 to 5.

5. The golf ball of claim 4, wherein a Shore D hardness at the surface of the core ranges from 45 to 55.

6. The golf ball of claim 4, wherein a Shore D hardness of the intermediate layer ranges from 40 to 60.

7. The golf ball of claim 1, wherein the thickness of the intermediate layer ranges from 0.5 mm to 1.7 mm.

8. A multi-piece golf ball comprising a core, an intermediate layer enclosing the core, and a cover layer which encloses the intermediate layer and has on an outside surface thereof a plurality of dimples, wherein the cover layer is harder than the intermediate layer; letting A be the thickness of the intermediate layer, B be the thickness of the cover layer and C be the diameter of the core, $65 \geqq C/A \geqq 30$ and $65 \geqq C/B \geqq 31$; a specific gravity of the core ranges from 1.0 to 1.2, a specific gravity of the intermediate layer ranges from 0.88 to 1.00, and the ball has an initial velocity, as measured by a method set forth in the Rules of Golf using an initial velocity measuring apparatus of the same type as the USGA drum rotation-type initial velocity instrument, of at least 77.0 m/s.

9. The golf ball of claim 8, wherein the dimples have a volume ratio CR with respect to the volume of the cover of at least 4% but not more than 10%.

10. The golf ball of claim 8, wherein the core has a diameter of at least 35.3 mm but not more than 38.7 mm.

11. The golf ball of claim 8, wherein a difference between a Shore D hardness of the intermediate layer and a Shore D hardness at the surface of the core ranges from 1 to 5.

12. The golf ball of claim 11, wherein a Shore D hardness at the surface of the core ranges from 45 to 55.

13. The golf ball of claim 11, wherein a Shore D hardness of the intermediate layer ranges from 40 to 60.

14. The golf ball of claim 8, wherein the thickness of the intermediate layer ranges from 0.5 mm to 1.7 mm.

* * * * *